US005564719A

United States Patent [19]

Kisselmann

[11] Patent Number: 5,564,719

[45] Date of Patent: Oct. 15, 1996

[54] SKI BOOT RELEASE SYSTEM FOR SNOWBOARDS

[76] Inventor: Claus Kisselmann, Fichtenstrasse 20, 82110 Germering, Germany

[21] Appl. No.: 166,725

[22] Filed: Dec. 14, 1993

[30] Foreign Application Priority Data

Dec. 16, 1992 [DE] Germany ..... 9217214 U

[51] Int. Cl.[6] ..... A63C 9/18

[52] U.S. Cl. ..... 280/14.2; 280/613

[58] Field of Search ..... 280/14.2, 14.3, 280/613, 611, 622, 631, 632, 634, 809

[56] References Cited

U.S. PATENT DOCUMENTS

| | | | |
|---|---|---|---|
| 3,992,037 | 11/1976 | Frechin | 280/613 |
| 4,165,887 | 8/1979 | Bunn, Jr. | 280/613 |
| 4,915,400 | 4/1990 | Chambers | 280/14.2 |
| 4,955,632 | 9/1990 | Prestipino Giarritta et al. | 280/14.2 X |
| 4,973,073 | 11/1990 | Raines et al. | 280/14.2 X |
| 5,362,087 | 11/1994 | Agid | 280/611 |

FOREIGN PATENT DOCUMENTS

| | | | |
|---|---|---|---|
| 0352662 | 1/1990 | European Pat. Off. | 280/14.2 |
| 2647025 | 11/1990 | France | 280/14.2 |
| 2663235 | 12/1991 | France | 280/14.2 |

*Primary Examiner*—Brian L. Johnson

*Attorney, Agent, or Firm*—Bardehle, Pagenberg, Dost, Altenburg, Frohwitter, Geissler & Partners

[57] ABSTRACT

A snowboard having a pair of bindings for ski boots, with the bindings being arranged on the snowboard one behind the other. A release mechanism is provided for releasing a ski boot from the rearward binding wherein the mechanism is activated at a location near the forward binding and at approximately knee height.

4 Claims, 3 Drawing Sheets

SKI BOOT RELEASE SYSTEM FOR SNOWBOARDS

FIELD OF THE INVENTION

The present invention relates to releasable bindings used with apparatus for sliding or skiing over snow generally, and with snowboards in particular.

BACKGROUND ART OF THE INVENTION

When using a snowboard to move over snow, the forward shoe or boot of a user, while being involved in this sport, is normally buckled and thereby connected to the board.

The rearward boot must be released by the user from time to time to propel him or herself along flat areas of the snow track or in preparation of ascending by a drag lift motion.

In contrast to a skier, a snow boarder does not have the convenience of releasing the rearward ski boot binding by inserting a ski pole, because ski poles are not used in snowboarding. Further, the binding cannot be released by the insertion of a ski boot, since the forward ski boot is locked in a binding during snowboard motion. The sportsperson, therefore, has to bend down or squat substantially in order to release the binding of the rearward ski boot. In the case of a plate binding, a lever has to be activated which involves the use of strength. In the case of shell bindings, buckles have to be opened, similar to plastic buckles found on ski boots. The degree of bending or squatting which has been required is of a disadvantage, especially when the sportsperson is queued up on a ski lift where the necessary space to maneuver is not available. Moreover, it is uncomfortable and inconvenient for the sportsperson to bend or squat down far enough to reach his or her feet.

SUMMARY OF THE INVENTION

It is, therefore, an object of the invention to provide a snowboard with a more convenient release mechanism for the rearward binding.

A remote release in accordance with the invention allows a substantially simplified dismount from a rearward binding without the use of excessive strength. Skilled users of the snowboard, for example, may open the binding while the snowboard is in motion. They can thereby repeatedly propel themselves with the freed leg, and remount again to achieve a quicker and easier traversing of flat portions of a snow track without requiring excessive bending or squatting.

In using a snowboard with a remote release for the rearward binding in accordance with the present invention, the forward leg of the user is the principal support for the user's body on the snowboard, because the forward leg remains locked in a shoe binding of the snowboard during the snowboarding activity.

An extended arm or cord end of a release mechanism for the rearward boot or shoe is fitted along the user's forward leg, and is activated by an upward pull. The pull force is translated into a push force on the rearward binding to release the heel jaw of the binding.

The locking of the rearward binding normally is achieved against the bias of a spring by stepping into the binding and exerting the added body weight of the user on the heel jaw of the binding mechanism. The invention also is applicable to shell bindings wherein one shell remains on the shoe which is releasably connected to a holding device on the board by way of an adapter plate below the shell.

In each of the above embodiments, the rearward binding can be released by activating the release mechanism of the rearward binding at a point of activation in proximity with the knee of the forward leg.

By means of the remote release in accordance with the invention, the user of the snowboard can open the rearward binding to take short rests and can easily remount when resuming the snowboarding activity. He does not have to support himself on his knees or sit, as has been required by prior art systems.

Further inventive aspects of the snowboard invention are set forth in the claims.

DESCRIPTION OF PREFERRED EMBODIMENTS

Figure 1:
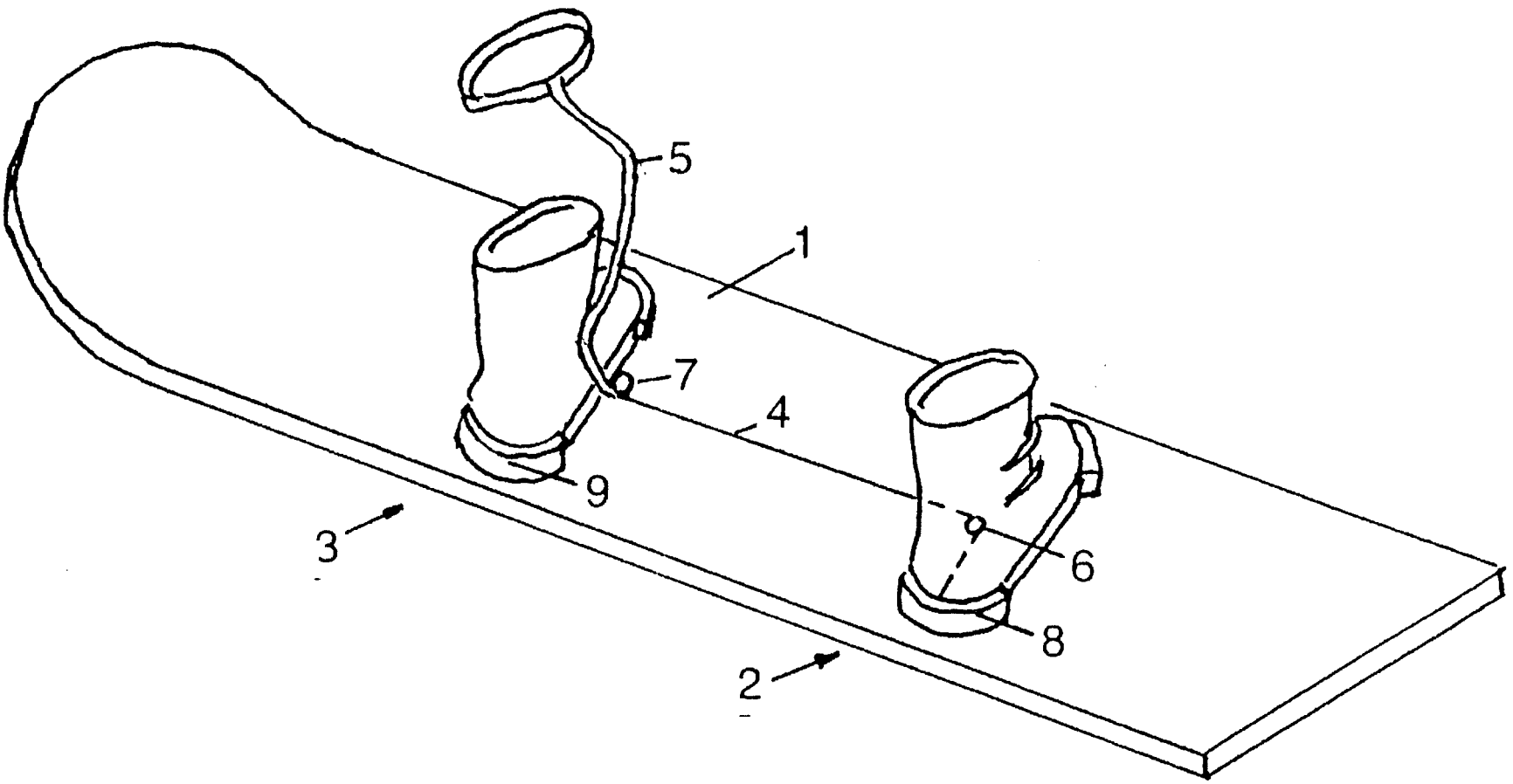
FIG. 1 is a perspective view of a snowboard in accordance with the invention.

Referring to FIG. 1, a snowboard 1 is shown which has a rearward binding 2 and a forward binding 3. The longitudinal axes of the bindings are slanted relative to the longitudinal axis of the snowboard.

Figure 2:
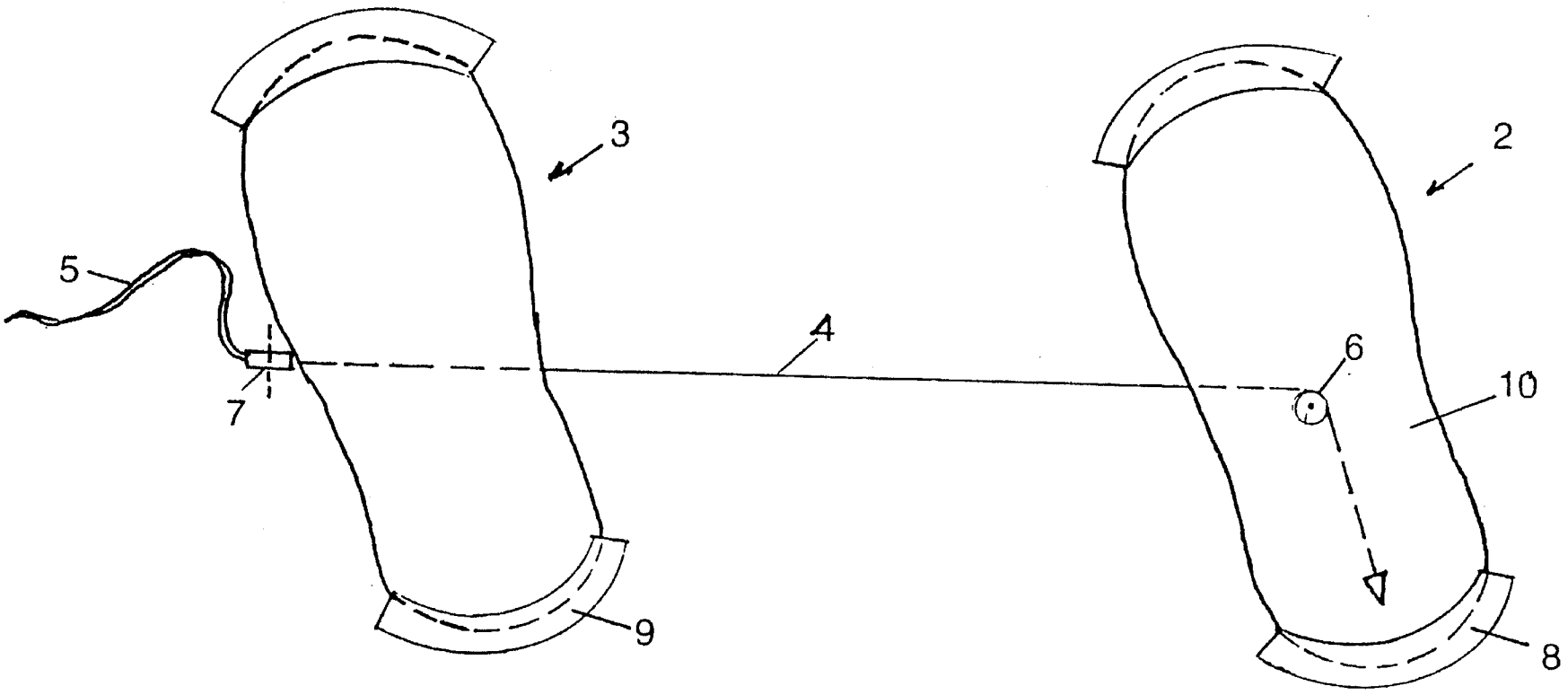
FIG. 2 is a top view of a snowboard in accordance with the invention which has bindings arranged thereon with a remote release.

FIG. 2 illustrates the construction of shoe or boot bindings which consist of a stationary forward jaw and a releasable rearward jaw 8, 9. When mounting or stepping into the rearward jaws 8, 9, the shoe is locked against the bias of a spring. For the release of the rearward jaw 8 on the rearward binding 2, a remote release mechanism comprising a pull cord 4 is used. The release of the forward binding 3 normally occurs only at the end of the snowboard sliding activity, and requires the use of the hand of the user.

The release mechanism for the rearward binding 2 includes the pull cord 4, which extends from the rearward jaw 8 in the longitudinal direction of the binding and around a deviation roller 6 toward the forward binding 3. The cord further extends around a second deviation roller 7 to cord end 5. The cord 4, by way of example only, may be guided along slits or channels in the upper surface of the snowboard, or in the alternative may be movably arranged under an antislip plate attached to the board's upper surface.

The cord end 5 of pull cord 4 may be extended along the forward leg of the snowboard user and held in place at its end at about the height of the knee for easy reach of the user. When a rearward shoe 10 is to be released, the cord end 5 may be gripped by the user and pulled. The rearward shoe 10 thereby is released from rearward jaw 8.

In the place of a pull cord 4, a pushing gear could also be used to translate the pull force on cord 4 into a push force on the rearward jaw 8 to release shoe 10. For the conversion of the pull force into a push force, levers, push rods and gears can be used, as is well known. Further, the pull cord 4 may be a cable, and the cord end 5 may be shaped as a handle, catching strap or catching belt as illustrated in FIG. 1. Still further, the cord end 5 may be arranged along either side surface of the forward shoe as illustrated by FIG. 1 in combination with FIG. 2.

Figure 3:
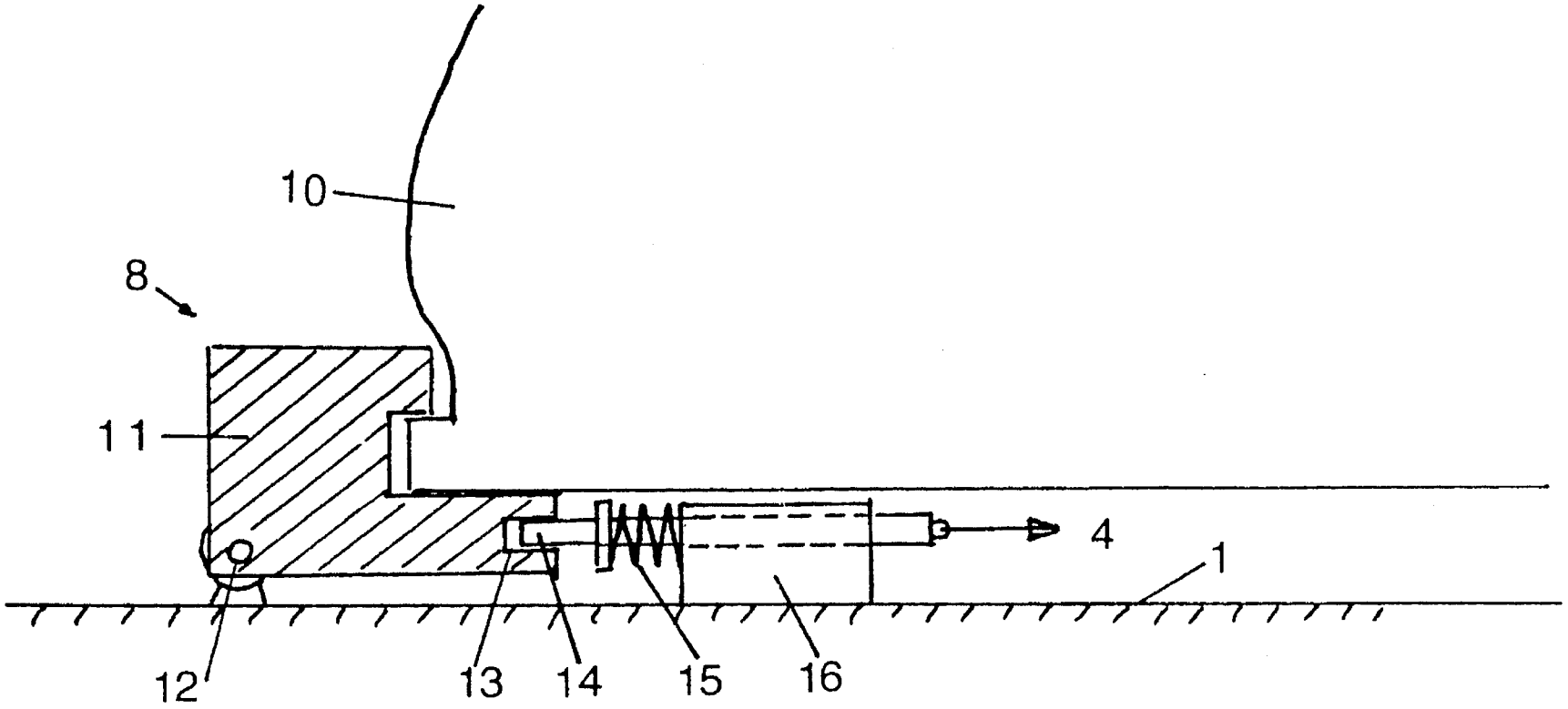
FIG. 3 is a side view, partially cross-sectioned, of a rearward jaw of a rearward binding in accordance with the invention.

In FIG. 3, the rearward jaw 8 of a rearward binding is illustrated in partial cross-sectional form. A heel block 11 is pivotal around its horizontal lateral axis 12, and includes a channel 13 which has been recessed to receive a blocking pawl 14. The blocking pawl 14 is supported by a guide 16 which is attached to the upper surface of the snowboard 1. The blocking pawl 14 may be pulled against the bias of a spring 15 by pulling on cord 4. The heel block 11 thereby can be freed to pivot upwardly and release the ski shoe 10.

While an embodiment of the present invention has been described above, it is clear that the present invention is not limited to that single embodiment and may be implemented in various other forms without departing from the spirit and scope of the appended claims.

What is claimed is:

1. A ski boot release system for a ski boot binding attached to a snowboard, which comprises:

(a) a heel block which is attached to said snowboard and which is pivotal about a horizontal axis, said heel block having a recess for receiving a heel part of a ski boot and a channel;

(b) a guide attached to said snowboard and having a horizontal tunnel formed therein;

(c) a blocking pawl extending through said horizontal tunnel and aligned with said channel when said heel block is in a horizontal position, and having an annular spring stop located between said guide and a first end of said blocking pawl, said first end being inserted into said channel under a longitudinal spring force for locking said heel block in place;

(d) a spring arranged around said blocking pawl between said annular spring stop and said guide to assert said longitudinal spring force; and (e) a member attached to a second end of said blocking pawl; wherein said spring is compressed when said member is pulled by a snowboard user to release said ski boot from said heel block.

2. The release system of claim 1; wherein said snowboard includes a pair of ski boot bindings, each attached to said snowboard at an angle with respect to a longitudinal axis of said snowboard, with one of said pair positioned behind the other of said pair along said longitudinal axis, said release system further comprising a first deviation roller in close proximity to a rearward binding of said pair and a second deviation roller in close proximity to a forward binding of said pair, and said member extending from said second end about said first deviation roller to said second deviation roller, and around said second deviation roller vertically upward to a location in proximity with a forward knee of a snowboard user.

3. The release system of claim 2, wherein said first deviation roller has a vertical axis and said second deviation roller has a horizontal transverse axis.

4. The release system of claim 1 wherein a pulling end of said member is handle shaped.

* * * * *